US007631462B1

(12) United States Patent
Rios

(10) Patent No.: US 7,631,462 B1
(45) Date of Patent: Dec. 15, 2009

(54) TEMPORARY SUPPORT SYSTEM FOR DRYWALL

(76) Inventor: Andrew Paul Rios, 2011 Alberti Ct., Las Vegas, NV (US) 89117

( * ) Notice: Subject to any disclaimer, the term of this patent is extended or adjusted under 35 U.S.C. 154(b) by 505 days.

(21) Appl. No.: 11/005,796

(22) Filed: Dec. 7, 2004

(51) Int. Cl.
*E04B 1/00* (2006.01)

(52) U.S. Cl. ..... 52/127.2; 52/127.5; 52/DIG. 1

(58) Field of Classification Search ..... 52/127.1, 52/127.2, 127.5, 127.6, 127.7, 127.8, DIG. 1
See application file for complete search history.

(56) References Cited

U.S. PATENT DOCUMENTS

| | | | | |
|---|---|---|---|---|
| 4,449,338 | A | 5/1984 | Reicherts | |
| 4,498,272 | A | 2/1985 | Adams | |
| 4,709,460 | A | 12/1987 | Luhowyj | |
| 4,709,527 | A | 12/1987 | Cooley | |
| 4,782,642 | A | 11/1988 | Conville | |
| 5,040,344 | A * | 8/1991 | Durand | 52/127.2 |
| 5,163,799 | A * | 11/1992 | Lynn | 414/11 |
| 5,224,309 | A | 7/1993 | Bodell | |
| 5,249,405 | A | 10/1993 | Miller | |
| 5,371,994 | A | 12/1994 | Waters | |
| 5,407,183 | A | 4/1995 | Singltary | |
| 5,564,236 | A | 10/1996 | McKinney | |
| 5,640,826 | A * | 6/1997 | Hurilla, Jr. | 52/749.14 |
| 5,761,876 | A * | 6/1998 | Keady | 52/749.13 |
| 6,131,361 | A | 10/2000 | Murphy | |
| 6,622,438 | B2 | 9/2003 | Hurlock | |

* cited by examiner

*Primary Examiner*—Richard E Chilcot, Jr.
*Assistant Examiner*—Elizabeth A Plummer
(74) *Attorney, Agent, or Firm*—Lewis and Roca LLP

(57) ABSTRACT

A new and unique temporary support system for installing drywall panels on ceilings and walls. This system is ideal for large commercial and residential ceilings spanning and supporting two large 4'×12'×⅝" sheets of drywall side by side on a fastening element at a plate by a protruding end and a hole. The opposite end, with a protruding end and a fixed spacer, is secured to a parallel framing structural member, the panels are slipped between the hangers and the framing structures, aligned and secured. The hangers are easily removed and reused to install the next panel. The second set, ideal for handymen, Do-it-Yourselfers, additions and remodels will support one 4'×12'×⅝" panel on a ceiling. It is mounted on a fastening element at a plate on a parallel framing structure, the same as the first set, the panel is aligned and secured eliminating the cumbersome task of holding the panel in place to secure.

13 Claims, 4 Drawing Sheets

TEMPORARY SUPPORT SYSTEM FOR DRYWALL

The present invention relates to the temporary support of drywall panels to joists or studs, including but not limited to plywood, particle board, or T-1-11. Installers face the cumbersome task of lifting, aligning, and securing panel to ceiling joists. The present invention supports panels, leaving the installers hands free to align panels overhead and securing to framing members.

Typically, drywall panels installed on ceilings, firewalls, and in commercial buildings are ⅝"×4'×12' weighing about 110 lbs. each. These larger panels reduce joints, taping time, material, expense, thereby increasing production. The center of gravity on a panel of this size and weight, being close to the center, may require three installers, two lifting panel to joist and aligning, the other securing it to framing member.

The present invention allows two installers to slip panel between hanger and joist, securing panel, increasing productivity and lowering cost.

There have been various methods used to hold a sheet onto joists, one is the on the job approach of constructing a T from 2×4 studs cut to specific sizes and used to hold one end of panel against ceiling while it is nailed to framing member. With this type of support, there is always the possibility of bumping the support causing the T to collapse, shattering the sheet, and possible injury to the workers.

U.S. Pat. No. 5,249,405 to Miller (1993) describes a support device having a piercing end, a supporting tongue, and a striking end. The support device is driven into a ceiling joist by striking the end with a hammer, driving the piercing end into the ceiling joist to the proper depth. The tongue supports one end while the installer secures the opposite end working towards the support devices. This type of support with a piercing end, can split a framing member, limiting the strength of the ceiling joist and increasing the possibility of the large sheet to fall, injuring workers and shattering the sheet of drywall. Also, after repeatedly striking on the striking end, it would become difficult to remove the device embedded in the ceiling joist.

U.S. Pat. No. 4,449,338 to Reicherts (1984) describes an integral clamp and screw in the shape of an L and a supporting leg and a leg from which a screw projects through, and beyond the panel supporting leg. This clamp and screw requires predrilling a pilot hole at least every four feet, clamps are then inserted and easily tightened by hand. An extra procedure, time consuming, considering the average size of a residence or commercial buildings.

BACKGROUND OF INVENTION

Objects and Advantages

Several objects and advantages are:

(a) a new and unique system capable of spanning and supporting two large sheets of drywall side by side.

(b) to provide a new and improved system of installing drywall on ceilings and walls.

(c) to provide a system easily understood, simple to use, easily removed after panel is secured and used repeatedly.

(d) to provide a method of supporting large sheets of drywall used on ceilings, firewalls, and commercial work.

(e) to provide an invention, lightweight, durable, easily stored and transported.

(f) to provide a system low in cost, susceptible to Handymen, Do-it-Yourselfers, and anyone skilled in the art.

SUMMARY

In accordance with the present invention, a new and unique improved support system, one set capable of spanning and supporting two large sheets of drywall side by side. The other set spans and supports one large sheet, is ideal for Handymen, Do-it-Yourselfers, and for remodeling.

DRAWINGS

Figure 4:
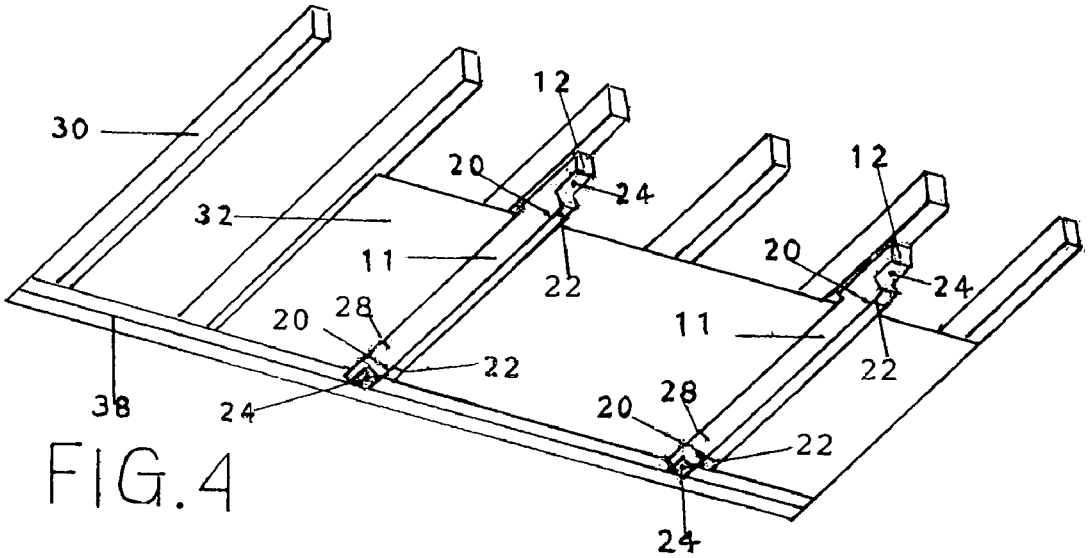

FIG. 4 still another perspective view of the preferred embodiment looking up, of the temporary support system (11) supporting one panel (32) to parallel framing structural members (30) by a fastening element (10) secured to the parallel structural members (30).

Figure 5:
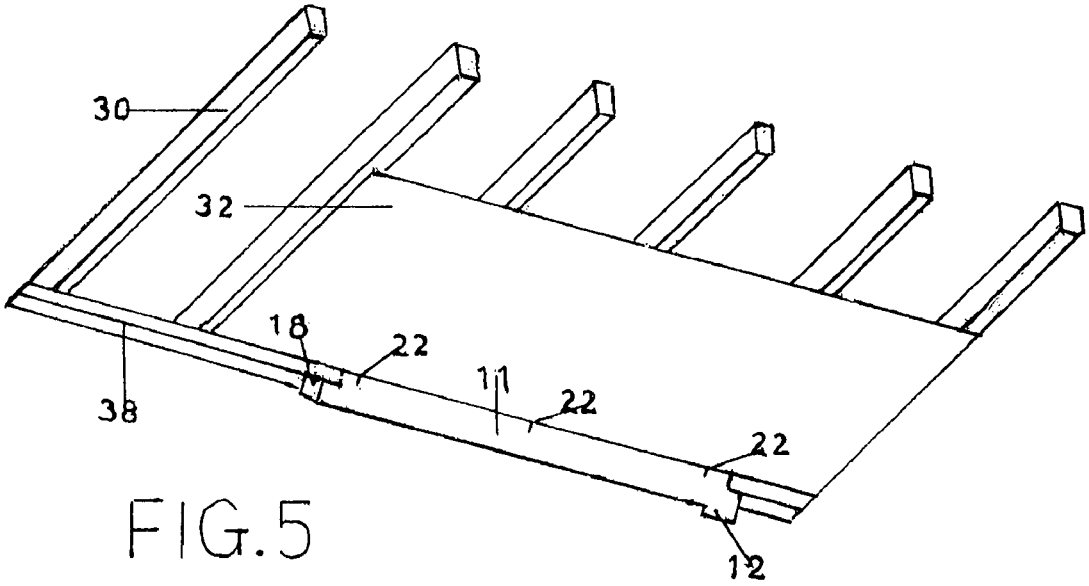

FIG. 5 still another perspective view looking up, of a panel (32), being supported by the temporary support system (11) in a horizontal position, by a fastening element (10) at a plate (38) mounted onto holes (20) for use in hallways, walk-in-closets or where parallel framing structures run in the opposite direction other than preferred.

Figure 6:
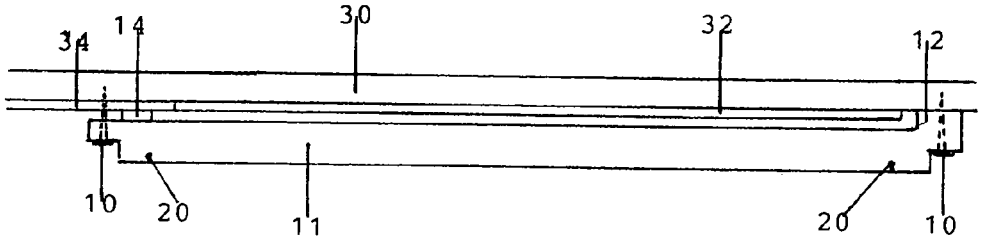

FIG. 6 is an elevational view showing position of spacer (14) placed on previously hung sheet (34) for the necessary clearance needed to install panel (32) between support system (11) and parallel framing structures (30).

Figure 7:
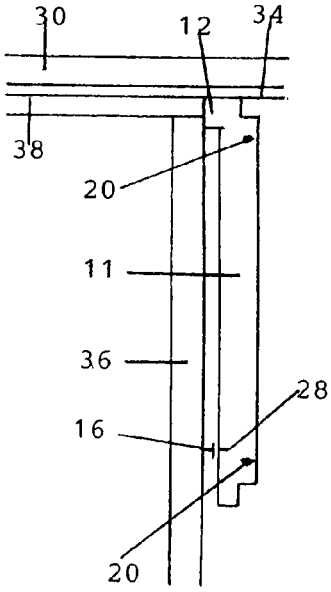

FIG. 7 is the side elevational view showing hanger (11), in a vertical position, protruding end with a fixed spacer (12), placed on previously hung sheet (34), and a black notch (28) showing placement for fastening elements (16) on said parallel structural members (36).

Figure 7A:
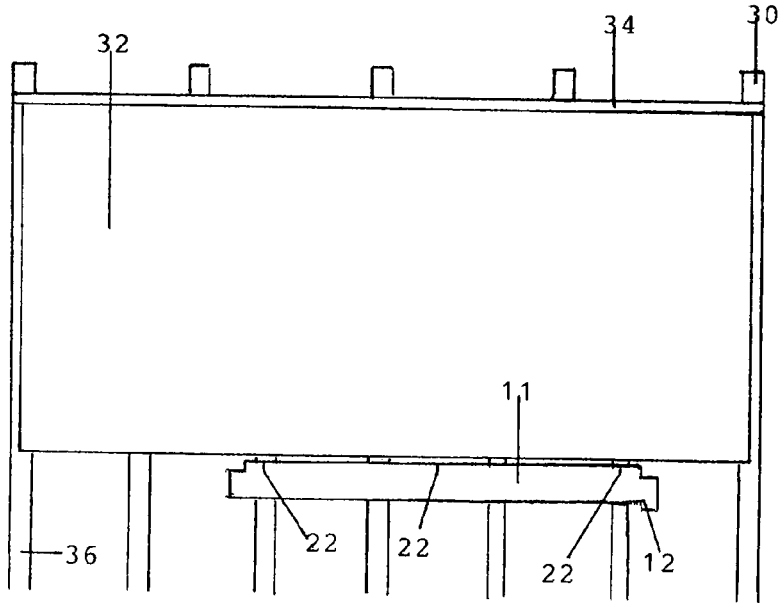

FIG. 7A is a front perspective view showing hanger (11) in a horizontal position, temporarily supporting a panel (32) on holes (20) mounted on exposed screw or nail (16) to the parallel framing structural members (36).

DRAWING REFERENCE NUMERALS WORKSHEET

Part Name

11 Drywall hanger.

10 Screw secures hanger to ceiling joist.

12 Fixed spacer provides clearance for drywall sheet.

14 Spacer placed on previously hung drywall sheet for clearance.

16 Nail or screw head exposed to mount hanger.

18 Hole at end of hanger used to insert nail or screw head at plate.

20 Two holes used to mount hanger on studs or plate.

22 Three red notches show location of ceiling joist and placement of nails or screws on studs or plate.
24 Hole for screw to go through to secure to ceiling joist.
26 Wood block or equivalent interior at both ends holds screw in place and guides screw through to ceiling joist.
28 Black notch used to mark placement of exposed nails or screw heads on studs.
30 Ceiling joist.
32 Drywall sheet being hung.
34 Previously hung sheet of drywall.
36 Stud.
38 Double plate.

DETAILED DESCRIPTION

Figure 1:
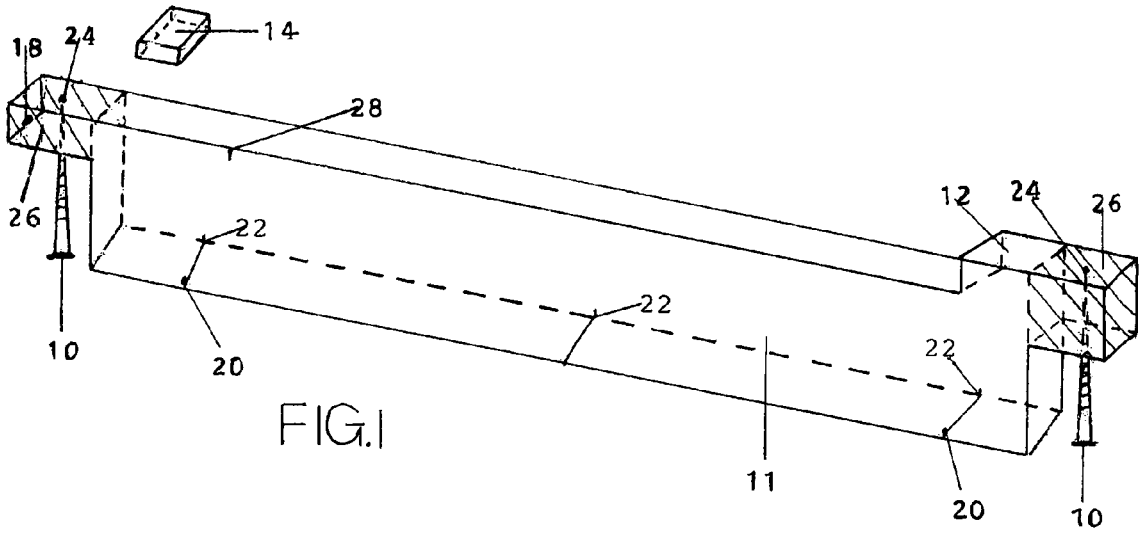
FIG. 1 is an isometric front view of the present invention as seen from above.
Figure 2:
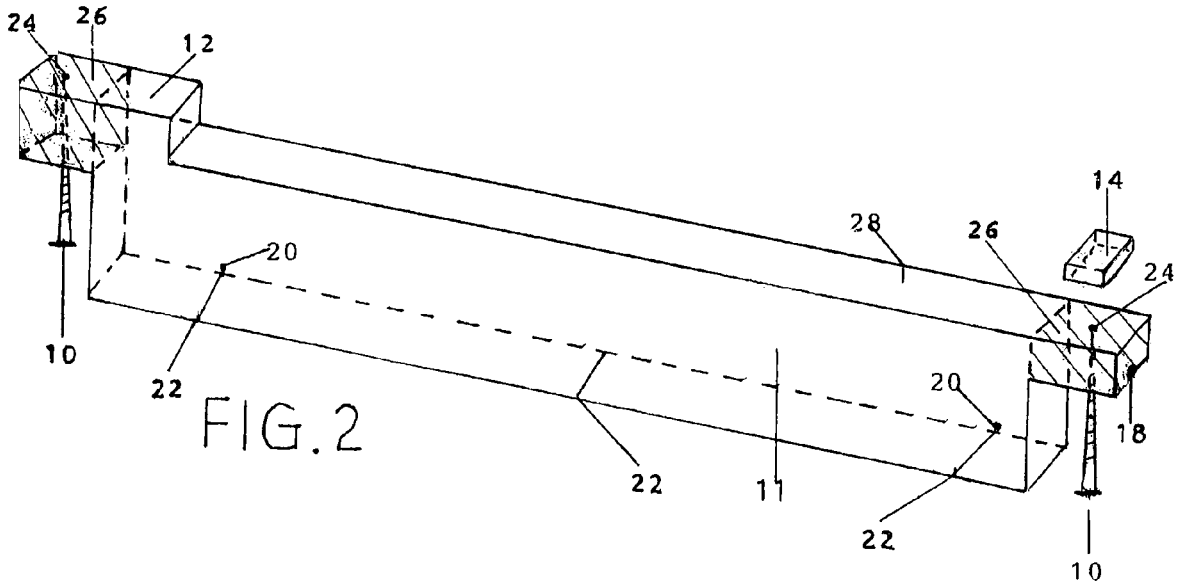
FIG. 2 is an isometric rear view of the same tool shown in FIG. 1 as seen from above.

Referring now to FIG. 1 and FIG. 2 showing a support hanger (11) of sufficient length to span panels (32) comprised of 25 gauge rigid metal with a hollow core, protruding ends with a wood block or equivalent interior (26) used to hold screw (10) 2½" long in place and guide through hole (24) securing to ceiling joist (30). At one end of the hanger, (11) a 1 inch offset with a protruding end and a hole (18) used to insert onto exposed nail or screw (16) at plate (38). Opposite end also with a 1 inch protruding end and a wood block or equivalent with a fixed spacer (12) ⅝" thick is secured to ceiling joist (30) with screw (10) 2½" in length through hole (24). A detached spacer (14) ⅜" thick placed on previously hung sheet of drywall (34) approximately one inch from the end, allows added clearance needed to slip sheet (32) between hanger (11) and ceiling joist (30) securing with screw (10) through previously hung sheet of drywall (34). Fixed spacer (12) end held in vertical position against previously hung sheet (34) using black notch (28) to mark location of screw or nails (16) at 48½". Three red notches (22) placed against studs (36) or plates (38) determine location of nails or screws (16) to mount hanger (11) in the vertical position onto two holes (20) 48 inches apart, for temporary support of drywall (32). In practice, these dimensions have proved satisfactory.

OPERATION

Figure 3:
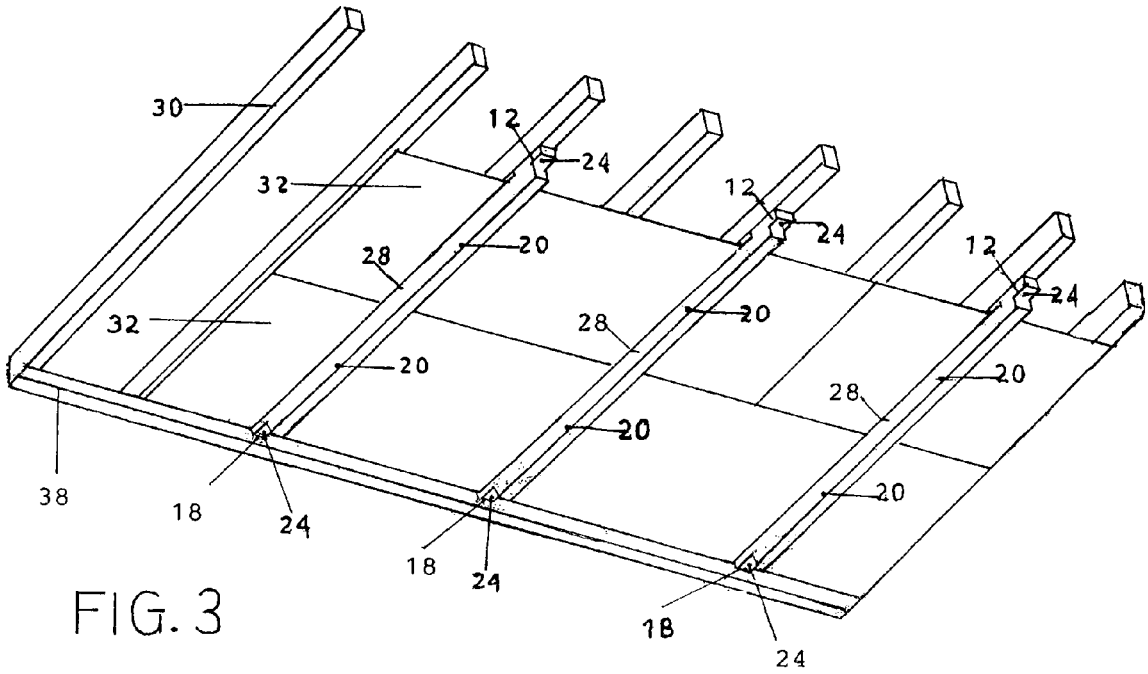
FIG. 3 is a perspective view, looking up, of the preferred embodiment showing two large 4'×12'×⅝" panels (32) being temporarily supported by a fastening element (16) at a plate (38). The opposite end, with a fixed spacer (12), is secured to parallel structural members (30), by a fastening element (10).

FIG. 3 is a view of the first preferred embodiment, looking upward of two 4'×12' drywall panels 32 side by side, supported and spanned by three hangers 11 mounted on a hole 18 at end of hanger on a screw or nail 16 exposed at plate 38. The opposite end, with a protruding end and a wood block or equivalent interior 26 guides screw 10 through hole 24 panel is then slipped between ceiling joist 30 and hangers 11. Panels 32 are secured, hangers 11 are easily removed and reused to install the next sheet.

Figure 3A:
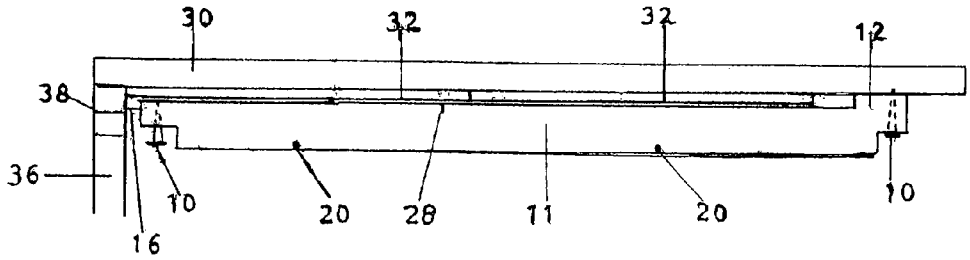
FIG. 3A is an elevational view of the preferred embodiment showing the temporary support of a ceiling panel (32) mounted on a fastening element (16) at a plate (38), the opposite end with a fixed spacer (12), secured by a fastening element (10) to said parallel framing structural members (30).

FIG. 3A is a front view of hanger 11 spanning and supporting two panels 32 side by side with hole 18 inserted onto screw or nail 16 on plate 38, opposite end showing screw 10 through fixed spacer 12 with wood block or equivalent 26 to guide screw 10 through hole 24 securing to ceiling joist 30.

FIG. 4 still another view of the preferred embodiment, looking upward of the shorter hanger 11 set using two hangers 11 spanning and supporting a 4'×8' panel 32 on a screw or nail exposed 16 at plate 38 inserted into hole 18. The opposite end with a fixed spacer 12 secured with screw 10 through hole 24 and wood block or equivalent 26 secured to ceiling joist 30. Hangers are easily removed and reused to install the next sheet.

FIG. 5 is a view looking upward of hanger 11 in a horizontal position mounted onto plate 38 on screws or nail heads exposed 16 approximately 2" below ceiling joist 30 using red notches 22 to place screws or nails 16 using two holes 20 to mount hanger 11. Opposite side is lifted and secured to ceiling joist 30. Red notches show location of ceiling joist 30 covered by sheet 32. This method is used on hallways, smaller rooms and when ceiling joists 30 are in direction other than preferred.

FIG. 6 is the side view of hanger 11 showing detached spacer 14 placed on edge of previously hung sheet 34 to provide clearance for panel 32 to be slipped between hanger 11 and ceiling joist 30. Opposite end with fixed spacer 12 is secured to ceiling joist 30 with screw 10. Panel is secured to ceiling joist 30 and hangers 11 are removed.

FIG. 7 shows hanger 11 with fixed spacer end 12 in vertical position against pre-hung sheet 34 black notch 28 showing location of nail or screw exposed 16 on stud 36.

FIG. 7A depicts hanger 11 mounted on studs 36 on screws or nails exposed 16 supported by two holes 20 location determined by red notches 22. Drywall sheet being hung 32 is lifted approximately ½ inch and secured to studs 36.

Having described the preferred embodiments of the present invention, it is understood that the invention defined by the appended claims is not to be limited by particular details in above description as many variations are possible by anyone skilled in the art.

I claim:

1. A temporary support for the installation of drywall, comprising:

an elongated member having a first end, a second end, a top surface, a bottom surface and a pair of opposing side surfaces;

a first flange extending beyond the first end, the first flange having opposing upper and lower surfaces, the upper surface of the first flange being planar with the top surface of the elongated member, the first flange including a mounting hole formed from the top surface of the first flange to the bottom surface of the first flange;

a shoulder disposed at the second end of and at a distance above the top surface of the elongated member selected to allow a sheet of drywall to slide along the top surface of the elongated member, the shoulder having an upper surface substantially parallel to the top surface of the elongated member; and a second flange having opposing upper and lower surfaces and extending from the shoulder beyond the second end of the elongated member, the upper surface of the second flange planar with and extending from an upper surface of the shoulder, the second flange including a mounting hole formed from the top surface of the first flange to the bottom surface of the first flange.

2. The temporary support of claim 1, wherein the elongated member comprises a rigid metal skin formed over an interior member.

3. The temporary support of claim 2, wherein the first flange, the shoulder and the second flange are formed from and integral with the interior member.

4. The temporary support of claim 2, wherein the interior member is formed from wood.

5. The temporary support of claim 1, wherein the elongated member has a length selected to allow the width of a single sheet of drywall between the shoulder and the hole in the second flange.

6. The temporary support of claim 1, wherein the elongated member has a length selected to allow the width of two sheets of drywall between the shoulder and the hole in the second flange.

7. The temporary support of claim 1, wherein the first flange further includes an elongated mounting recess axially aligned with the elongated member and configured to engage a mounting screw or nail extending in a direction axially aligned with the elongated member.

8. The temporary support of claim 7, wherein the elongated mounting recess is a hole formed in axial alignment with the elongated member.

9. The temporary support of claim 1, further including:

a first hole formed in a selected one of the side surfaces of the elongated member, the first hole adapted to engage a head of a first mounting screw or nail; and a second hole formed in the selected one of the side surfaces of the elongated member, the second hole spaced apart from the first hole by a standard wall stud spacing distance and adapted to engage a head of a second mounting screw or nail.

10. The temporary support of claim 9, further including:

first indicia formed on the elongated member and aligned with the first hole; and second indicia formed on the elongated member and aligned with the second hole.

11. The temporary support of claim 10, wherein the first and second indicia are formed on the bottom surface of the elongated member.

12. The temporary support of claim 9, wherein the first flange further includes an elongated mounting recess axially aligned with the elongated member and configured to engage a mounting screw or nail extending in a direction axially aligned with the elongated member.

13. The temporary support of claim 12, wherein the elongated mounting recess is a hole formed in axial alignment with the elongated member.

* * * * *